US005961386A

United States Patent [19]

Sawaguchi

[11] Patent Number: 5,961,386

[45] **Date of Patent: *Oct. 5, 1999**

[54] COMPUTER SYSTEM FOR PLAYING COMPETING TYPE GAME WITH SPECIFIC CHARACTERISTIC REMOVABLE DATA

[75] Inventor: Takashi Sawaguchi, Hokkaido, Japan

[73] Assignee: Hudson Soft Co., Ltd., Hokkaido, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/763,452

[22] Filed: Dec. 11, 1996

[30] Foreign Application Priority Data

Dec. 12, 1995 [JP] Japan ..... 7-346490

[51] Int. Cl.[6] ..... A63F 9/22

[52] U.S. Cl. ..... 463/43; 463/42; 463/25

[58] Field of Search ..... 463/44, 43, 23, 463/11, 12, 13, 25

[56] References Cited

U.S. PATENT DOCUMENTS

| | | | |
|---|---|---|---|
| 4,764,666 | 8/1988 | Bergeron | 463/25 |
| 4,858,930 | 8/1989 | Sato | 463/44 |
| 4,926,327 | 5/1990 | Sidley | 463/12 |
| 5,048,831 | 9/1991 | Sides . | |
| 5,112,051 | 5/1992 | Darling et al. | 463/23 |
| 5,159,549 | 10/1992 | Hallman, Jr. et al. | 463/11 |
| 5,203,848 | 4/1993 | Wang | 273/148 B |
| 5,275,400 | 1/1994 | Weingardt et al. | 463/12 |
| 5,362,068 | 11/1994 | Liu | 463/44 |
| 5,395,112 | 3/1995 | Darling | 463/44 |
| 5,552,799 | 9/1996 | Hashiguchi | 273/148 B |
| 5,586,257 | 12/1996 | Pulman | 463/23 |

FOREIGN PATENT DOCUMENTS

| | | |
|---|---|---|
| 0 534 718 A2 | 3/1993 | European Pat. Off. . |
| 2 161 629 | 1/1986 | United Kingdom . |
| WO 89/06405 | 7/1989 | WIPO . |
| WO 93/23125 | 11/1993 | WIPO . |

*Primary Examiner*—Michael O'Neill
*Attorney, Agent, or Firm*—McDermott, Will & Emery

[57] ABSTRACT

In a computer system for playing a computer game of the present invention, the computer game is a competing type game and specific characteristic data of each of game players is stored in a memory card of each game player. The specific characteristic data is removable from one memory to another memory in accordance with result of the competing game. The memory card is detachable from the computer system. Further, the computer system is able to be connected with a network. Therefore, a skill of the game player is displayed and stored clearly and correctly. Further, each skill of the game players is displayed on all display units of the game players at same time on the network. Therefore, all game players are able to play a same computer game at the same time on the network and one game player is able to recognize the skills of other game players on the network

6 Claims, 9 Drawing Sheets

FIG. 5

| COMPETING RESULT RECORD | | | T.HORIO |
|---|---|---|---|
| INCREASE AND DECRASE OF MEDALS | | MEANS (OPPONENT) | NUMBER OF MEDALS |
| (1) | ———— | —— | STEEL*5 COPPER*7 SILVER*3 GOLD*1 DIAMOND*0 PRIDE*0 |
| (2) | +STEEL*3 | PART-TIME JOB | STEEL*8 COPPER*7 SILVER*3 GOLD*1 DIAMOND*0 PRIDE*0 |
| (3) | -STEEL*2 COPPER*3 | T.GOI | STEEL*6 COPPER*4 SILVER*3 GOLD*1 DIAMOND*0 PRIDE*0 |

COMPUTER SYSTEM FOR PLAYING COMPETING TYPE GAME WITH SPECIFIC CHARACTERISTIC REMOVABLE DATA

FIELD OF THE INVENTION

The invention relates to a computer system for playing a computer game, and more particularly, to a computer system for playing a competing type game which has specific characteristic removable data.

BACKGROUND OF THE INVENTION

A conventional computer system for playing a computer game comprises a game unit, control pads, an amplifier, a speaker, and a display unit. The game unit comprises a CPU (Central Processing Unit), a ROM (Read-Only Memory), a RAM (Random Access Memory), an image data output unit, a sound data output unit, a CD-ROM drive, CD-ROM I/F (InterFace), a N/W (NetWork) I/F, and pad I/Fs.

A computer game is stored in a CD-ROM. The CD-ROM is placed in the CD-ROM drive. The computer game is loaded from the CD-ROM into the RAM via the CD-ROM drive and the CD-ROM I/F by the CPU executing a load command in the ROM. The computer game is played by driving the control pad through the pad I/F. Further, a game image is displayed on the display unit by the image data output unit. A game sound is reproduced through the speaker by the sound data output unit and the amplifier.

Almost the computer games are played by one person. On the other hand, in a competing type game, a opponent is a program of the competing type game. Therefore, once a game player has won the programmed opponent, the game player loses interest in the competing type game, because the game player masters a winning pattern of the competing type game.

Therefore, in a recently competing type game, the opponent is a human. Namely, the recently competing type game is played at the same time by two or more than human players. Further, a conventional computer system for playing a computer game is connected with a network via the N/W I/F. Therefore, all game players are able to play a same computer game on the network.

In a conventional competing type game, score points are gotten by winning a opponent. For example, in a fighting type game of the conventional competing type game, the score points of the fighting game are determined by times of knocking down a character of a opponent. The score points are displayed on a display unit with the name of the winner game player.

In a conventional computer system for playing a computer game, however, there are disadvantages in that score points of the competing type game such as a fighting type game are not correctly in correspondence with a skill of a game player, because if a opponent is weak the score points are to be a high score, if a opponent is strong the score points are to be a low score.

SUMMARY OF THE INVENTION

Accordingly, it is an object of the invention to provide a computer system for playing a computer game in which a skill of a game player is displayed and stored clearly and correctly.

It is another object of the invention to provide a computer system for playing a competing type game of a computer game in which specific characteristic data of a game player is removable.

According to the first feature of the invention, a computer system for playing a computer game, comprises memory means for storing specific characteristic data of the computer game, a CPU for processing the computer game, and means for updating the stored specific characteristic data in accordance with result of the processed computer game.

According to the second feature of the invention, a computer system for playing a competing type game of a computer game, comprises memory means for storing specific characteristic data of the computer game, memory means for storing another specific characteristic data of the computer game, a CPU for processing the computer game, and means for removing the specific characteristic data from one memory means to another memory means in accordance with result of the processed computer game.

BRIEF DESCRIPTION OF THE DRAWINGS

The invention will be described in more detail in conjunction with the accompanying drawings, wherein:

FIG. 5 is a block diagram of specific characteristic data of a competing type game of the present invention;

DETAILED DESCRIPTION OF THE PREFERRED EMBODIMENTS

Before explaining a computer system for playing a computer game in the preferred embodiment according to the invention, the above mentioned conventional computer system for playing a computer game will be explained in FIG. 1.

Figure 1:
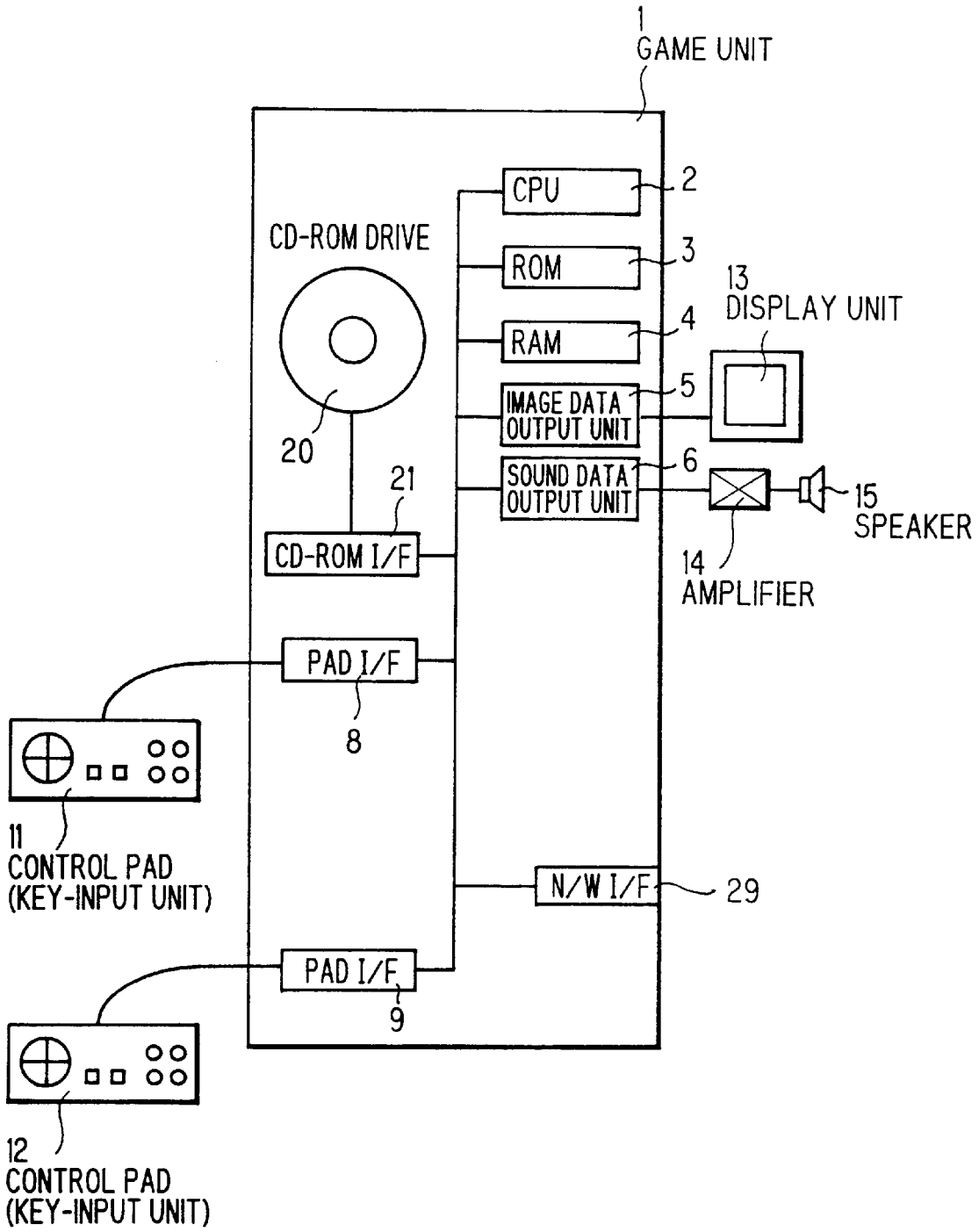
FIG. 1 PRIOR ART
FIG. 1 is a block diagram of a conventional computer system for playing a computer game.

FIG. 1 is a block diagram of a conventional computer system for playing a computer game. The conventional computer system for playing a computer game comprises a game unit 1, control pads 11 and 12, an amplifier 14, a speaker 15, and a display unit 13. The game unit 1 comprises a CPU (Central Processing Unit) 2, a ROM (Read-Only Memory) 3, a RAM Random Access Memory) 4, an image data output unit 5, a sound data output unit 6, PAD I/Fs 8 and 9, a CD ROM drive 20, a CD-ROM I/F (interface) 21, and a N/W netWork) I/F 29.

A computer game, for example a shooting game, an action game, an adventure game, a roll play game, a simulation game, a puzzle game, or a competing type game, is stored in a CD-ROM. The CD-ROM is placed in the CD-ROM drive 20. The computer game is loaded from the CD-ROM into the RAM 4 via the CD-ROM drive 20 and the CD-ROM I/F 21 by the CPU 2 executing a load command in the ROM 3. The computer game is played by driving the control pads 11 and/or 12 through the pad I/Fs 8 and/or 9. Further, a game image is displayed on the display unit 13 by the image data output unit 5. A game sound is reproduced through the speaker 15 by the sound data output unit 6 and the amplifier 14.

Almost the computer games are played by one person. On the other hand, in a competing type game, a opponent is a program of the competing type game. Therefore, once a game player has won the programmed opponent (namely, the game player has cleared (completed) the competing type game), the game player loses interest in the competing type game, because the game player masters a winning pattern of the competing type game.

Therefore, in a recently competing type game, the opponent is a human. Namely, the recently competing type game is played at the same time by two more than human players.

Further, a conventional computer system for playing a computer game is connected with a network such as a LAN (Local Area Network) or a global area network via the N/W I/F 29. Therefore, two or more than game players are able to play a same computer game at the same time on the network.

In a conventional competing type game, a game player is gotten score points when the game player wins a opponent. For example, in a fighting type game of the conventional competing type game, the score points of a game player are determined by times of knocking down a character of a opponent. The score points of the game player are displayed on a display unit with the name of the game player when the game player has won the opponent.

In a conventional computer system for playing a computer game, however, there are disadvantages in that score points of the competing type game such as a fighting type game are not correctly in correspondence with a skill of a game player, because when a game player wins a weak opponent (i.e. a opponent is a poor game player), even if the skill of the game player is not high level, the times of knocking down a character of the weak opponent are many then the winner player may have a high score, and when a game player wins a strong opponent (i.e. a opponent is a good player), even if the skill of the game player is high level, the times of knocking down a character of the strong opponent are very few then the winner player may not have a high score.

Therefore, a computer system for playing a computer game is needed to display and store a skill of a game player clearly and correctly.

Next, a computer system for playing a computer game in the first preferred embodiment according to the invention will be explained in FIGS. 2 to 9.

Figure 2:
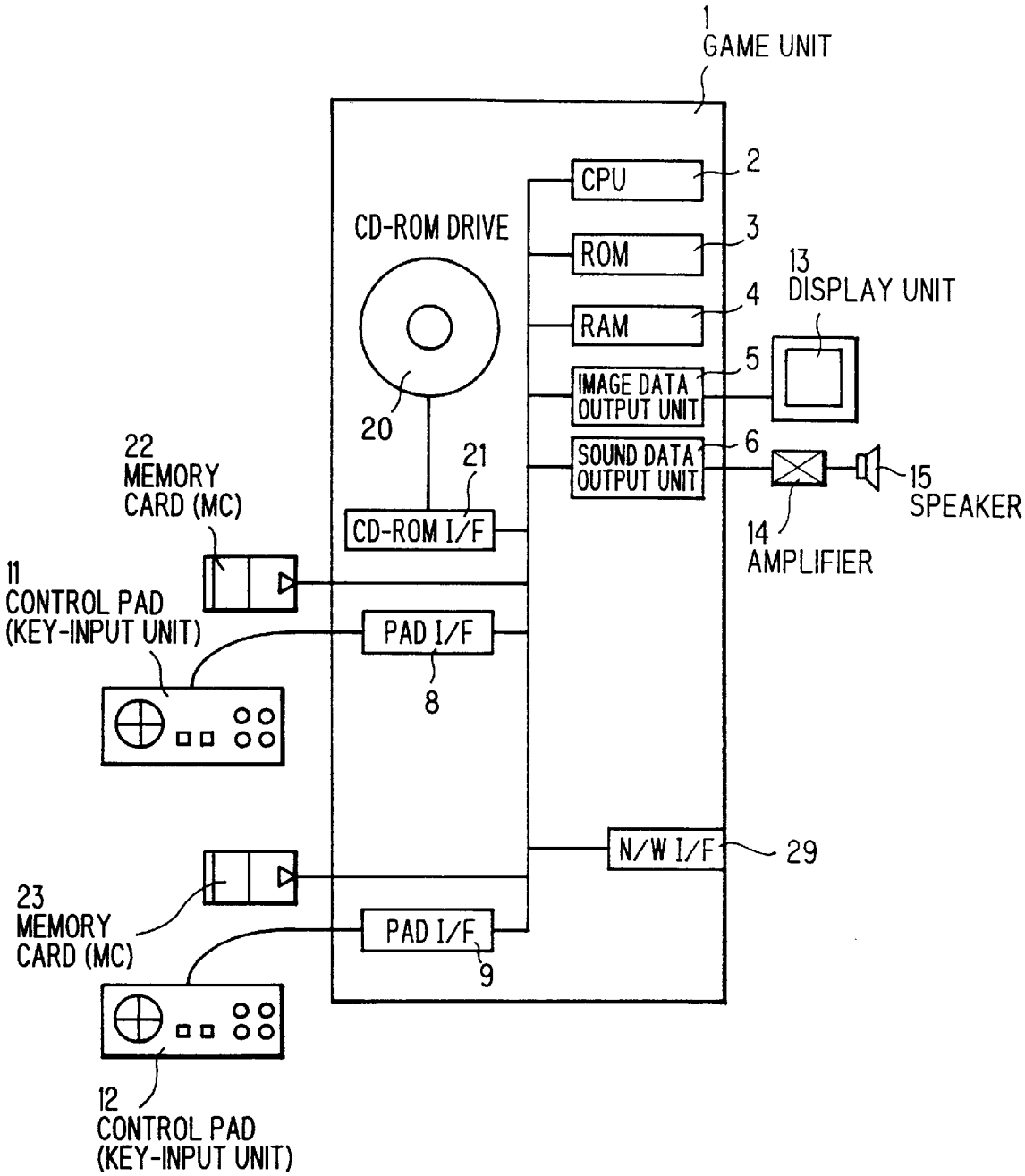
FIG. 2 is a block diagram of a computer system for playing a computer game of the present invention.

FIG. 2 is a block diagram of a computer system for playing a computer game of the present invention. The computer system for playing a computer game comprises a game unit 1, control pads 11 and 12, memory cards 22 and 23, an amplifier 14, a speaker 15, and a display unit 13. The game unit 1 comprises a CPU 2, a ROM 3, a RAM 4, an image data output unit 5, a sound data output unit 6, PAD I/Fs 8 and 9, a CD-ROM drive 20, a CD-ROM I/F (interface) 21, and a N/W I/F 29.

A computer game is stored in a CD-ROM. The CD-ROM is placed in the CD-ROM drive 20. The computer game is loaded from the CD-ROM into the RAM 4 via the CD-ROM drive 20 and the CD-ROM I/F 21 by the CPU 2 executing a load command in the ROM 3. The computer game is played by driving the control pads 11 and/or 12 through the pad I/Fs 8 and/or 9. Further, a game image is displayed on the display unit 13 by the image data output unit 5. A game sound is reproduced through the speaker 15 by the sound data output unit 6 and the amplifier 14.

The memory cards 22 and 23 store specific characteristic data of a competing type game. The memory cards 22 and 23 are needed to be conditions as follows:

(1) the memory cards 22 and 23 are non-volatile memories;

(2) the memory cards 22 and 23 are updatable; and (3) a game player can not update the specific characteristic data in the memory cards22 and 23.

For example, the memory cards 22 and 23 are SRAMs (Static Random Access Memory), flash memories, or EEPROMs (Electric Erasable Programmable Read-Only Memory). Further, a program of the competing type game inhibits the game player from updating the specific characteristic data.

The memory cards 22 and 23 are owned by the game player. The memory cards 22 and 23 are able to be detached from the game unit 1 and to be carried.

Figure 3:
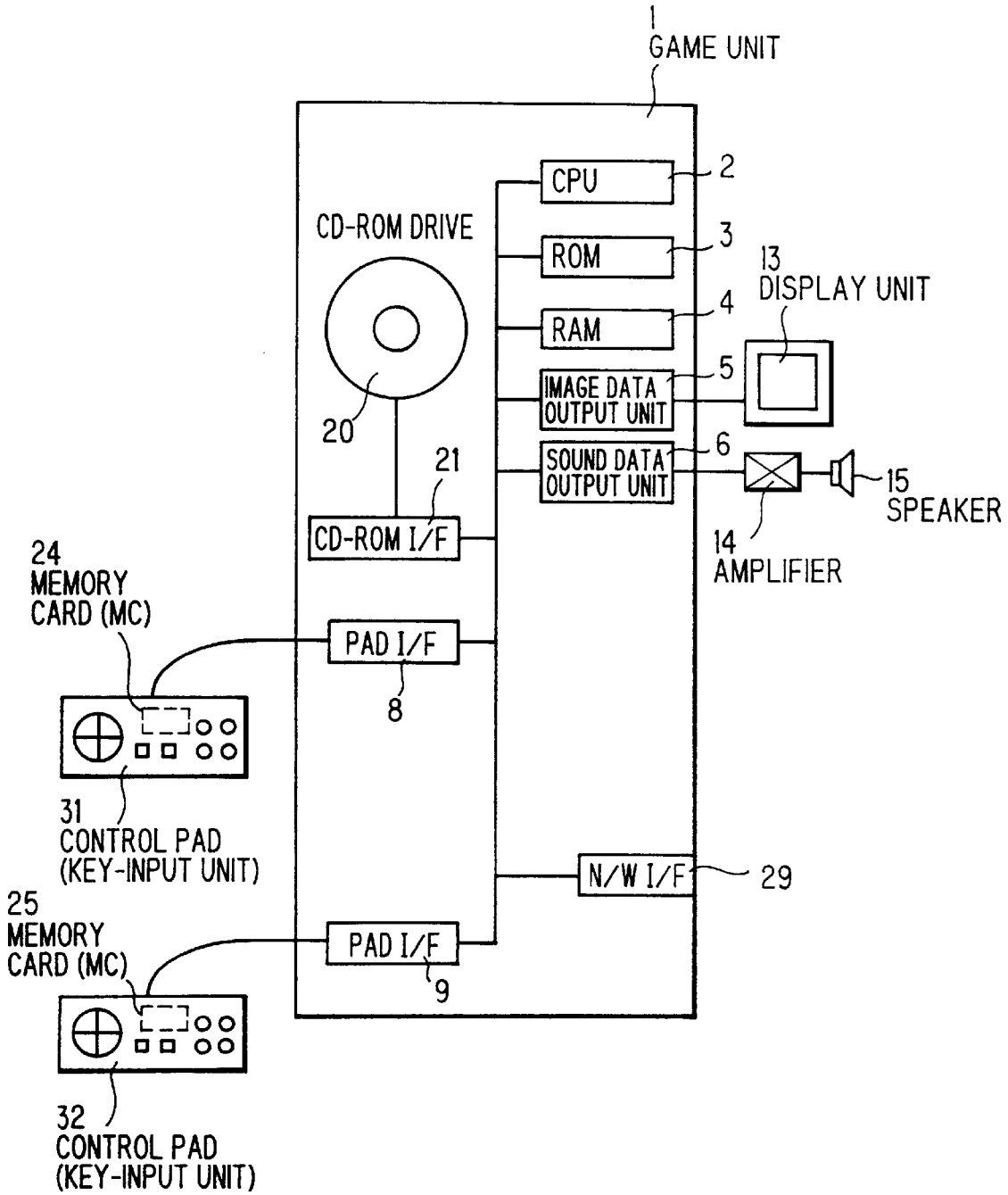
FIG. 3 is a block diagram of a computer system for playing a computer game of the present invention.

In another preferred embodiment according to the invention, FIG. 3 is a block diagram of a computer system for playing a computer game of the present invention. In FIG. 3, control pads 31 and 32 includes memory cards 24 and 25. The memory cards 24 and 25 has same conditions as the memory cards 22 and 23. In this case, other type games (not competing type game) are also played by using the control pads 31 and 32. Further, the CD-ROM drive 20 may be replaced with a ROM cartridge.

Figure 4:
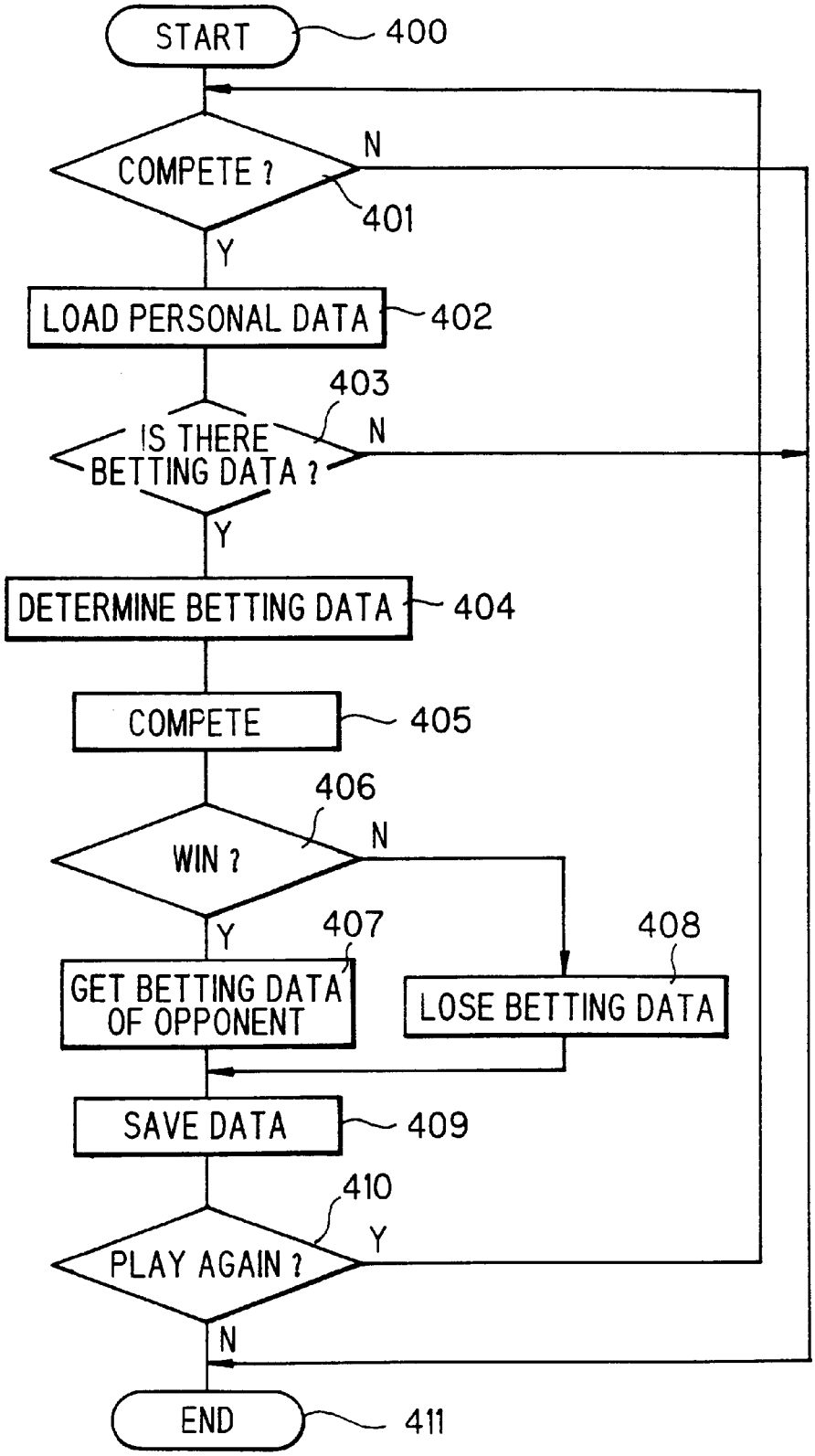
FIG. 4 is a simplified processing flow chart of a competing type game with specific characteristic removable data of the present invention.

FIG. 4 is a simplified processing flow chart of a competing type game with specific characteristic removable data of the present invention. In FIG. 4, the competing type game is started at the step 400. At the step 401, a message of "COMPETE ?" is displayed and two game players select "YES" or "NO". If any game player selects "NO", the competing type game is ended at the step 411. If both game players select "YES", the step 402 follows. At the step 402, personal data (specific characteristic data) of each game players is loaded from a memory card of the game player. At the step 403, it is confirmed whether each game player has the personal data or not to be bet. If any game player does not have the betting personal data, the competing type game is ended at the step 411. If both game players have the betting personal data, the step 404 follows. At the step 404, each game player determines betting data from the personal data. Next, at the step 405, the game players compete with each other. At the step 406, a winner is determined. The winner gets the betting data of the opponent (another game player) at the step 407. A defeated game player loses the betting data at the step 408. At the step 409, new (updated) personal data of each game player is saved into the memory card of each game player. At the step 410, the game players determine either playing again or not. If both game players select "AGAIN", the step 401 is returned. If any game player selects "NOT AGAIN", the competing game is ended at the step 411.

FIG. 5 is a block diagram of specific characteristic data of a competing type game of the present invention. In FIG. 5, the specific characteristic data are steel, copper, silver, gold, diamond and pride medals. Ten steel medals are equal to one copper medal. Ten copper medals are equal to one silver medal. Ten silver medals are equal to one gold medal. Ten gold medals are equal to one diamond medal. Ten diamond medals are equal to one pride medal. At an initial state of the competing type game, the pride medal is one and each other medals are nine. When a game player has no medals, the player can not play the competing type game. However, the game player can play a part-time job game such as a penalty game. The game player gets medals in accordance with the result of the part-time job game.

The result of the competing type game is recorded into the memory card of the game player at a passbook type. In FIG. 5, the player gets three steel medals at the part-time job game, then the steel medals of the game player are eight (5+3=8). Next, the game player loses two steel medals and three copper medals at competing with Mr. T.GOI, so that the steel medals are six (8−2=6) and the copper medals are four (7−3=4).

Figure 6:
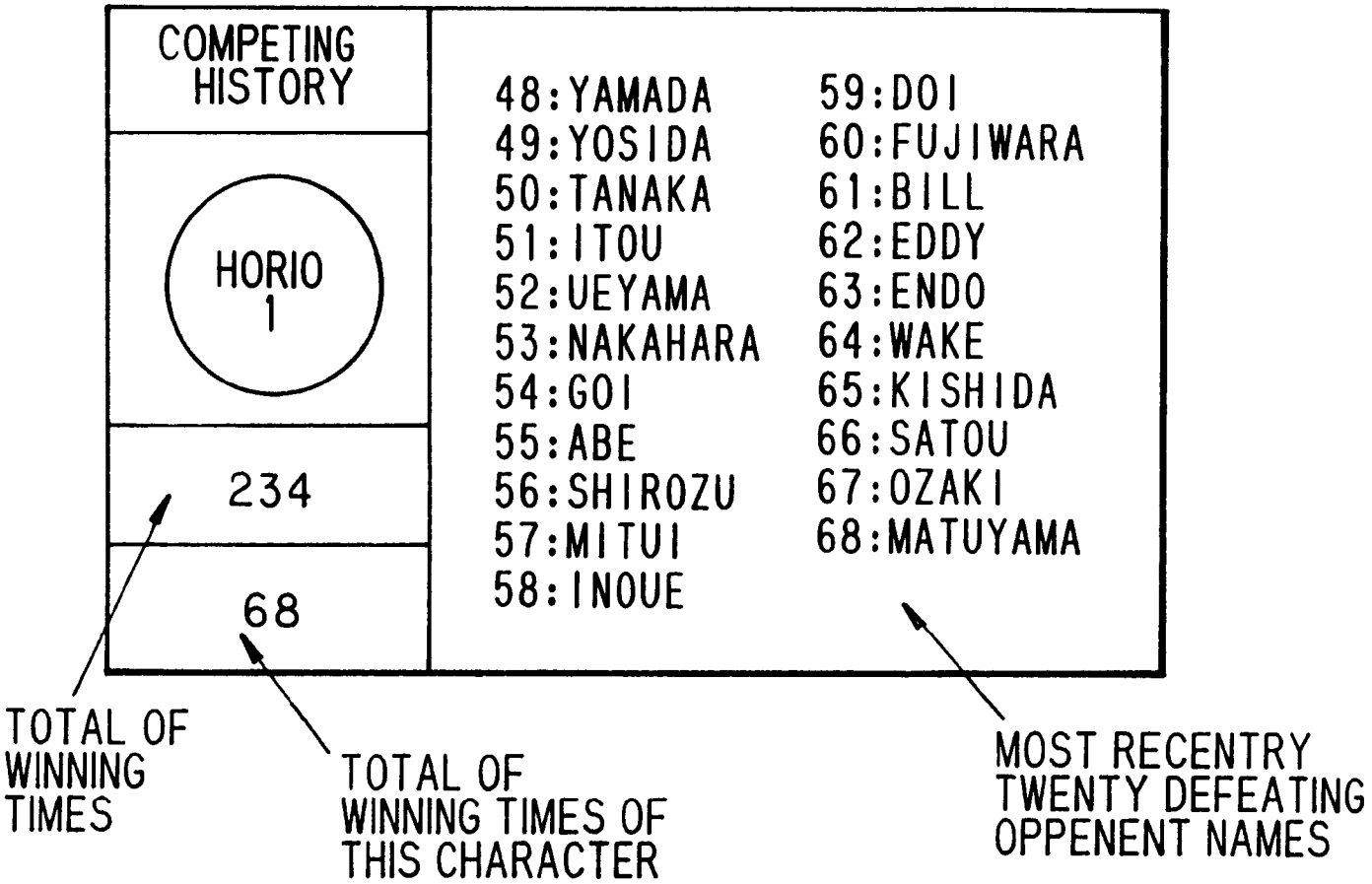
FIG. 6 is a block diagram of a displayed competing history of the present invention.
Figure 7:
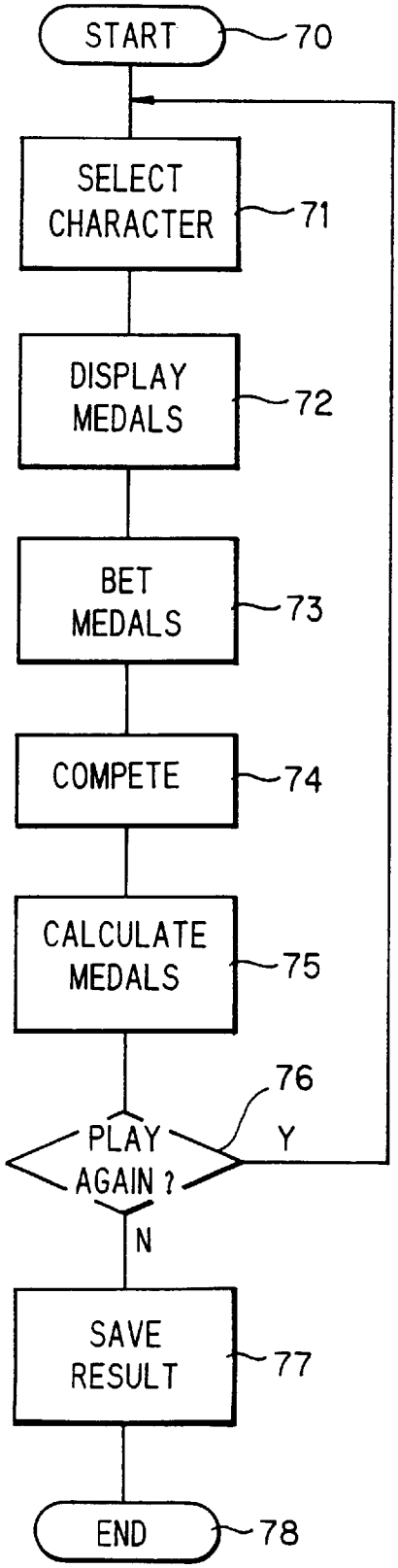
FIG. 7 is a simplified processing flow chart of a competing type game with specific characteristic removable data of the present invention.

FIG. 6 is a block diagram of a displayed competing history of the present invention. The competing history of the competing type game is stored in the memory card with the defeating opponent names. Numbers of the stored defeating opponent names are limited to twenty by a memory area of the memory card. Therefore, only most recently twenty defeating opponent names are stored in the memory card In further preferred embodiment according to the invention, FIG. 7 is a simplified processing flow chart of a competing type game with specific characteristic removable data of the present invention. At the step 70, the competing type game is started. In this competing type game, game players are two. Each of the game players selects a game character at the step 71, for example, in a car race game, each of the game players selects a racing car. The medals of both game players are displayed on the display unit at the step 72. Each of the game players bets some medals which are not seen by another player (opponent). At the step 74, the game players compete with each other. When the competition is ended, the medals of each of the game players are calculated by a program of the competing type game in accordance with victory or defeat (at the step 75). At the step 76, the game players determine either playing again or not. If both game players select "AGAIN", the step 71 is returned. If any game player selects "NOT AGAIN", the step 77 follows. At the step 77, the medals of each of the game players, namely the game results, are saved in each memory card. At the step 78, the competing type game is ended.

Figure 8:
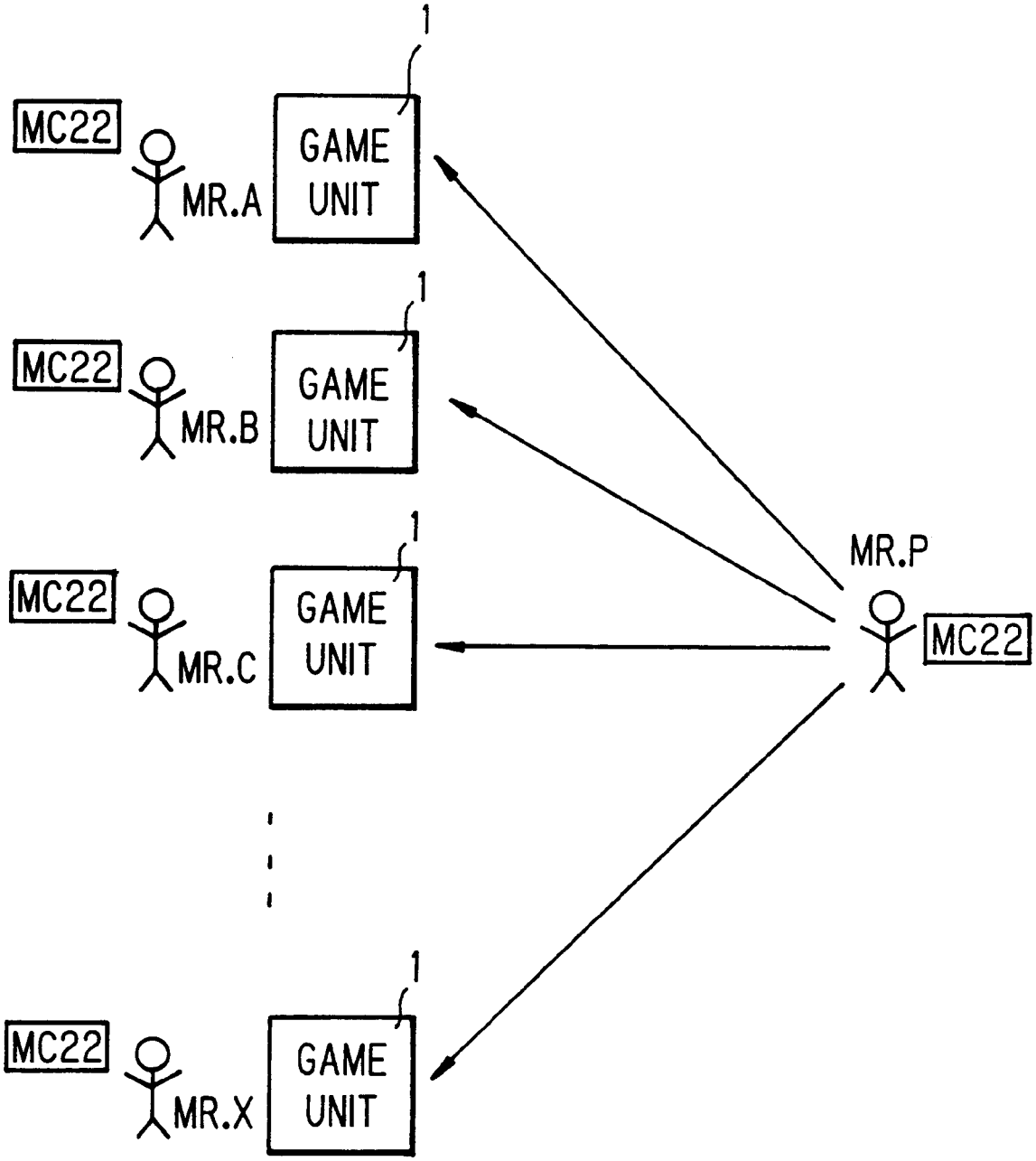
FIG. 8 is a block diagram of searching for an opponent of the present invention.

FIG. 8 is a block diagram of searching for an opponent of the present invention. In FIG. 8, Mr. P searches for an opponent. Both Mr. P and the opponent must have a memory card 22 or a control pad with a memory card.

Figure 9:
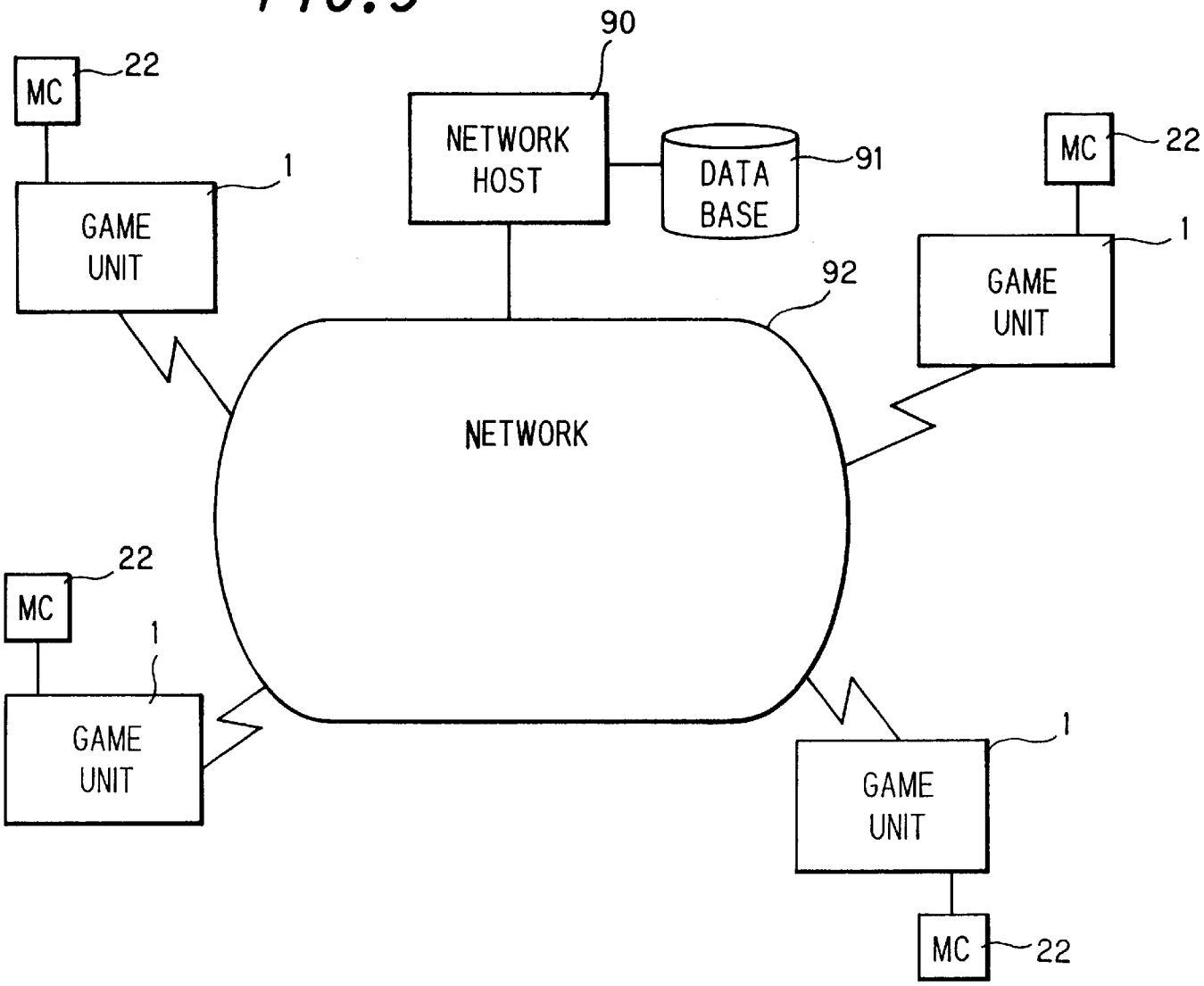
FIG. 9 is a block diagram of a network for connecting game units with each other.

FIG. 9 is a block diagram of a network for connecting game units with each other. In FIG. 9, a network 92 is controlled by a network host 90. The network host has a data base 91. Game units 1 having memory cards 22 are connected with each other through the network 92. All personal data, such as specific characteristic data, of all game players are stored in the data base 91.

Therefore, in the above computer system for playing a computer game, a skill of a game player is displayed and stored clearly and correctly. Further, each skill of game players is displayed on all display units of the game players at same time on the network. Therefore, all game players can play a same computer game at the same time on the network and one game player can recognize skills of other game players on the network. Further, in the computer system for playing a competing type game of a computer game, specific characteristic data of a game player is removable.

As this invention may be embodied in several forms without departing from the spirit of essential characteristics thereof, the present embodiment is therefore illustrative and not restrictive, since the scope of the invention is defined by the appended claims rather than by the description proceeding them, and all changes that fill within meets and bounds of the claims, or equivalence of such meets and bounds are therefore intended to embraced by the claims.

What is claimed is:

1. A computer game system in which two human players compete against each other comprising:

a ROM for storing a computer game;

a RAM into which the ROM loads the computer game;

a CPU controlling the loading of the computer game into the RAM and executing the game;

at least two control units, each used by a player to play the computer game;

at least two machine-readable medium each containing at least a first data and a separate second data, different from the first data, said first data corresponding to a respective player's ability to play the computer game, and the separate second data corresponding to previous accomplishment of said respective player in playing the computer game;

means for enabling each player to wager a portion of the data corresponding to his respective previous accomplishment in playing the computer game that he will defeat the other player when playing the computer game; and means for deducting the portion wagered of the data corresponding to previous accomplishment from the losing player and adding it to the winning player, wherein the data contained in said at least two machine-readable medium is not changed by any software stored in said ROM, and cannot be directly changed by the respective player.

2. The computer system according to claim 1, wherein said data corresponding to a respective player's ability to play the computer game is updated in accordance with a result of his winning and losing the computer game.

3. The computer system according to claim 1, wherein said said at least two machine-readable medium are detachable from said computer game unit.

4. A computer game system in which two human players compete against each other comprising:

a plurality of computer game units each including a ROM for storing a computer game, a RAM into which the ROM loads the computer game, a CPU controlling the loading of the computer game into the RAM and executing the game, at least two control units, each used by a player to play the computer game, at least two machine-readable medium each containing at least a first data and a separate second data, different from the first data, said first data corresponding to a respective player's ability to play the computer game, and the separate second data corresponding to previous accomplishment of said respective player in playing the computer game;

means for enabling each player to wager a portion of the data corresponding to his respective previous accomplishment in playing the computer game that he will defeat the other player when playing the computer game, and means for deducting the portion wagered of the data corresponding to previous accomplishment from the losing player and adding it to the winning player; and a network for connecting the plurality of computer game units with each other enabling said two human players to play the computer game via said network, wherein the data contained in said at least two machine-readable medium is not changed by any software stored in said ROM, and cannot be directly changed by the respective player.

5. The game system according to claim 4, wherein said data corresponding to a respective player's ability to play the computer game is updated in accordance with a result of his winning and losing the computer game.

6. The game system according to claim 4, wherein said said at least two machine-readable medium are detachable from said computer game unit.

* * * * *